United States Patent [19]

Ogino et al.

[11] 4,259,565

[45] Mar. 31, 1981

[54] METHOD OF CONTROLLING HEATERS FOR COPYING APPARATUS

[75] Inventors: Tetsuo Ogino, Nishinomiya; Takashi Sengo, Moriguchi; Toshio Yoshiyama, Sakai, all of Japan

[73] Assignee: Mita Industrial Company Limited, Osaka, Japan

[21] Appl. No.: 72,598

[22] Filed: Sep. 5, 1979

[30] Foreign Application Priority Data

Sep. 5, 1978 [JP] Japan ..... 53-109438

[51] Int. Cl.[3] ..... H05B 1/00; G03G 15/20

[52] U.S. Cl. ..... 219/216; 73/336.5; 219/388; 236/DIG. 13; 432/60

[58] Field of Search ..... 219/201, 216, 388, 469, 219/470, 471; 236/20 R, DIG. 13; 73/73, 336.5, 338; 101/426; 346/150; 432/60, 228; 34/28, 30

[56] References Cited

U.S. PATENT DOCUMENTS

| | | | |
|---|---|---|---|
| 2,229,612 | 6/1941 | Pierce | 236/DIG. 13 |
| 3,167,734 | 1/1965 | Brucken et al. | 73/336.5 |
| 3,234,868 | 2/1966 | Appeldorn et al. | 219/216 X |
| 3,618,368 | 11/1971 | Lesemann | 73/73 |
| 3,902,040 | 8/1975 | Ikeda et al. | 73/336.5 X |
| 4,172,975 | 10/1979 | Noda | 219/216 |

*Primary Examiner*—Volodymyr Y. Mayewsky
*Attorney, Agent, or Firm*—Wenderoth, Lind & Ponack

[57] ABSTRACT

A method of controlling dew formation preventing heaters for a copying apparatus which includes a first temperature detecting means for detecting the temperature inside the copying apparatus, with a first reference temperature (T1) being set, a second temperature detecting means for detecting the temperature inside the copying apparatus, with a second reference temperature (T2) higher than said first reference temperature (T1) being set, a humidity detecting means for detecting the humidity inside the copying apparatus, with a reference humidity (H1) being set, and a first group of heaters and a second group of heaters to be controlled by said temperature detecting means and said humidity detecting means. The method comprises the steps of:

(I) Heating said first and second groups of heaters when the temperature inside the copying apparatus is lower than the reference temperature (T1) of said first temperature detecting means, and (II) heating said second group of heaters when the temperature (T) inside the copying apparatus is higher than the reference temperature (T1) of said first temperature detecting means and lower than the reference temperature (T2) of said second temperature detecting means.

(II-a) with the humidity (H) inside the copying apparatus being higher than the reference humidity (H1) of said humidity detecting means.

1 Claim, 5 Drawing Figures

METHOD OF CONTROLLING HEATERS FOR COPYING APPARATUS

FIELD OF THE INVENTION

The present invention relates to a method of controlling heaters in copying apparatuses and more particularly, to a method of controlling heaters so as to prevent dew formation and troubles owing to high humidity which take place in copying apparatuses.

DESCRIPTION OF THE PRIOR ART

Conventionally, in the copying apparatuses, for example, in the electrophotographic copying apparatuses, there have been encountered various troubles such as indefinite copied images, copy paper jamming, etc. resulting from the dew formation on the photosensitive members, optical systems, etc.

Some causes of the dew formation may be related to district conditions, periods and time for using the copying apparatuses, and for example, owing to the coldness at nights, moisture in air is formed into dew on the photosensitive member, and optical system (mirrors, lens, etc.), or in the cold districts and the like, dew is formed owing to rapid temperature rise during starting of heating in rooms, thus giving rise to the troubles as described above.

Similarly, besides the photosensitive member and optical system, when the fixing section of the copying apparatus is constituted by pressure fixing rollers, the fixing tends to be imperfect or copy paper jamming is liable to take place owing to dew formed on such fixing rollers.

Meanwhile, in the copying apparatuses having dry type developing devices, there have been such drawbacks that sufficient developing is obstructed due to solidification of the developing material stored in the developing section.

For the prevention of the dew formation as described above, there has conventionally been proposed one method, for example, in Japanese Laid-Open Patent publication No. 3231/76 which is so arranged that, by respectively detecting temperatures inside and outside of the copying apparatus for comparison therebetween, the copying apparatus is held at a temperature higher than that outside said copying apparatus through heating of the photosensitive member and optical system based on the results of the above comparison. In the known method as described above, however, since vibrations of the temperatures inside and outside the copying apparatus are not perfectly aligned as shown in FIG. 1, dew is still formed due to the temperature difference (the hatched portion in FIG. (1) therebetween, even when a heater is controlled through mutual comparison between the temperatures in the interior and exterior of the copying apparatus.

Moreover, as the troubles similar to those owing to the dew formation as described above, when the humidity becomes high in rainy seasons, etc., the copy paper used for the copying apparatus absorbs a large amount of moisture, with resiliency of the copy paper being reduced, thus resulting in the jamming or wrinkles of the copy paper, with simultaneous reduction of the transfer efficiency so as to adversely affect the quality of the copied images.

SUMMARY OF THE INVENTION

Therefore, it is a primary object of the present invention to provide a method of controlling heaters for preventing dew formation and also for eliminating troubles arising from high humidity in a copying apparatus.

According to the present invention, there is provided a method of controlling heaters in a copying apparatus which includes first temperature detecting means for detecting the temperature inside the copying apparatus, with a first reference temperature (T1) being set, a second temperature detecting means for detecting the temperature inside the copying apparatus, with a second reference temperature (T2) higher than said first reference temperature (T1) being set, a humidity detecting means for detecting the humidity inside the copying apparatus, with a reference humity (H1) being set, and a first group of heaters and a second group of heaters to be controlled by said temperature detecting means and said humidity detecting means, said method comprising the steps of:

(I) Heating said first and second groups of heaters when the temperature inside the copying apparatus is lower than the reference temperature (T1) of said first temperature detecting means, and (II) heating said second group of heaters when the temperature (T) inside the copying apparatus is higher than the reference temperature (T1) of said first temperature detecting means and lower than the reference temperature (T2) of said second temperature detecting means, (II-a) with the humidity (H) inside the copying apparatus being higher than the reference humidity (H1) of said humidity detecting means.

More specifically, as shown in FIG. 2, according to the present invention, the method of controlling heaters in a copying apparatus comprises the steps of:

(I) heating the first and second groups of heaters so as to raise the temperature (T) inside the copying apparatus when the temperature inside the copying apparatus is lower than the reference temperature (T1) of the first temperature detecting means [regions (a) and (b)], and (II) heating only the second group of heaters when the temperature (T) inside the copying apparatus is higher than the reference temperature (T1) of the first temperature detecting means and lower than the reference temperature (T2) of the second temperature detecting means, (II-a) with the humidity (H) inside the copy apparatus being higher than the reference humidity (H1) of the humidity detecting means [region (c)] for preventing troubles arising from higher humidity.

These and other objects and features of the present invention will become apparent from the following description related to the preferred embodiment thereof with reference to the accompanying drawings.

DETAILED DESCRIPTION OF PREFERRED EMBODIMENTS

Subsequently, the present invention will be described in detail with reference to the attached drawings illustrating the preferred embodiments thereof.

Figure 3:
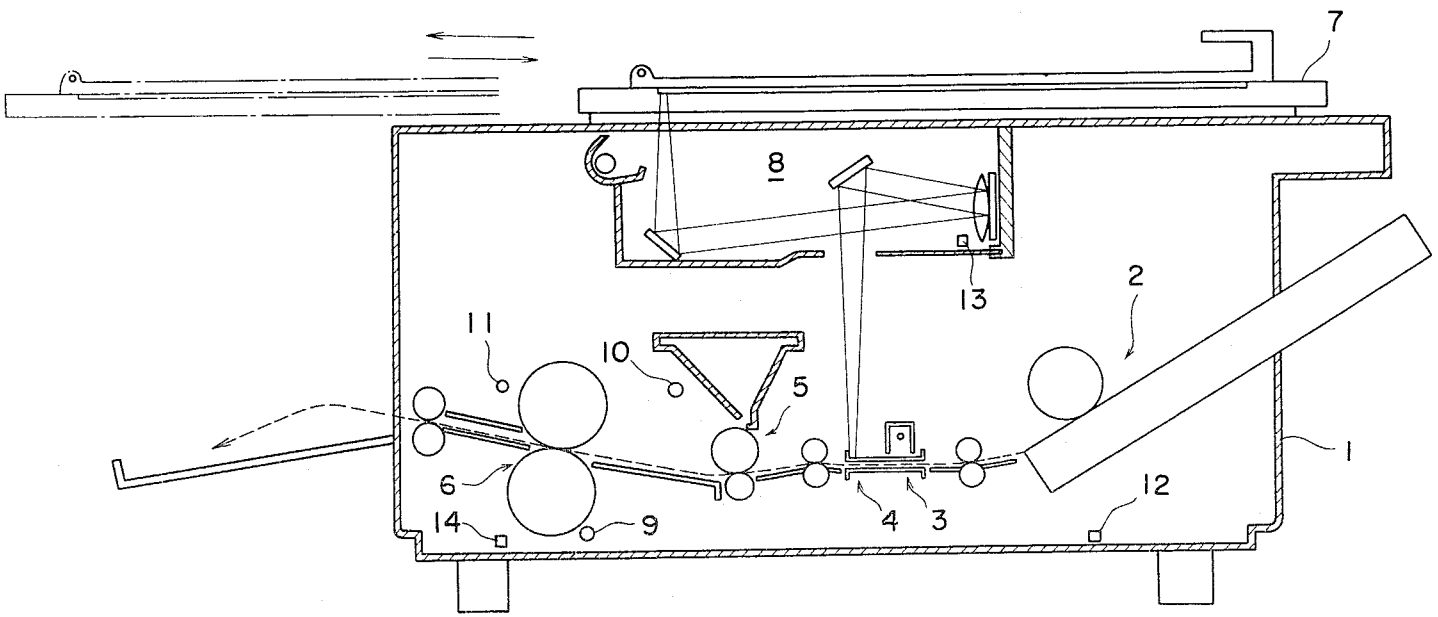
FIG. 3 is a schematic side sectional view of an electrostatic copying apparatus to which the method of the present invention may be applied.

In FIG. 3, there is shown an electrostatic copying apparatus which includes an apparatus housing 1 provided with a copy paper feeding section 2 for accommodating copy paper sheets therein for feeding said copy paper sheets one by one according to copy paper feeding signal. Along the path through which the copy paper sheet fed from the copy paper feeding section 2 is transported, there are sequentially disposed a corona charging device 3 for uniformly charging the copy paper sheet, an exposure section 4 for forming on image of an original to be copied on the copy paper sheet as an electrostatic latent image, a developing device 5 for supplying the developing material onto the electrostatic latent image formed at the exposure section 4, and a pressure roller fixing device 6 for fixing the developed image. Moreover, in association with the exposure section 4 described above, there is reciprocatingly disposed for movement in the horizontal direction, an original mounting table 7 for placing thereon the original document to be copied. Meanwhile, below said original mounting table 7, an optical system 8 including reflecting mirrors, lens assembly, etc. is disposed for optically transmitting the image of the original placed on the table 7 toward the exposure section 4 mentioned earlier.

Incidentally, according to the electrostatic copying apparatus as described above, troubles as follows are liable to take place due to dew formation and moisture.

More specifically, if the copy paper feeding section 2 is subjected to the dew formation or to high humidity, the copy paper sheets accommodated in the copy paper feeding section 2 are not fed one sheet by one sheet, but tend to be forwarded in a plurality of sheets due to the dew formation and high humidity, thus often resulting in copy paper jamming in the copying apparatus.

On the other hand, when the developing device 5 is subjected to the dew formation or high humidity, the developing material for the developing or replenishment stored in said developing device 5 is undesirably solidified, thus obstructing favorable development.

Meanwhile, if dew is formed in the pressure roller fixing device 6, the copy paper is apt to be wound onto the surfaces of the pressure rollers for said fixing device 6 so as to give rise to the copy paper jamming.

Furthermore, when the transparent plate of the original mounting table 7, and mirrors and lens, etc. provided in the optical system 8 are subjected to the dew formation, the image of the original to be copied is not faithfully transmitted onto the copy paper, and the resultant copied images become blackish, or deviation, distortion, etc. of the copied images tend to take place.

Moreover, also in the copy paper transporting path. etc., copy paper jamming and the like tend to be caused by guide plates and feeding rollers, and thus, many troubles are attributable to the dew formation and high humidity.

Accordingly, by the method of controlling heaters of the present invention, various troubles due to the dew formation and high humidity as described in the foregoing can substantially be eliminated.

More specifically, according to the method of the present invention, there are provided as shown in FIG. 3, a first temperature detecting means 9 set at a first reference temperature (T1), and a second temperature detecting means 10 set at a second reference temperature (T2) higher than said first reference temperature (T1).

Meanwhile, for detecting the humidity within the copying apparatus, a humidity detecting means 11 set at a reference humidity (H1) is provided.

The temperature variation in the copying apparatus is detected by said first temperature detecting means 9 and second temperature detecting means 10, while the variation of humidity in the copying apparatus is detected by said humidity detecting means 11, and according to the signals obtained thereby, the first and second groups of heaters are controlled for heating.

Although the groups of heaters as described above may be disposed at any places where dew is likely to be formed or troubles due to high humidity tend to take place, it may be so arranged, for example, that heaters 12 and 13 belonging to said first heater group are disposed at the copy paper feeding section 2 and the optical system 8, while a heater 14 belonging to said second heater group is installed at the fixing device 6 as shown in FIG. 3.

Figure 4:
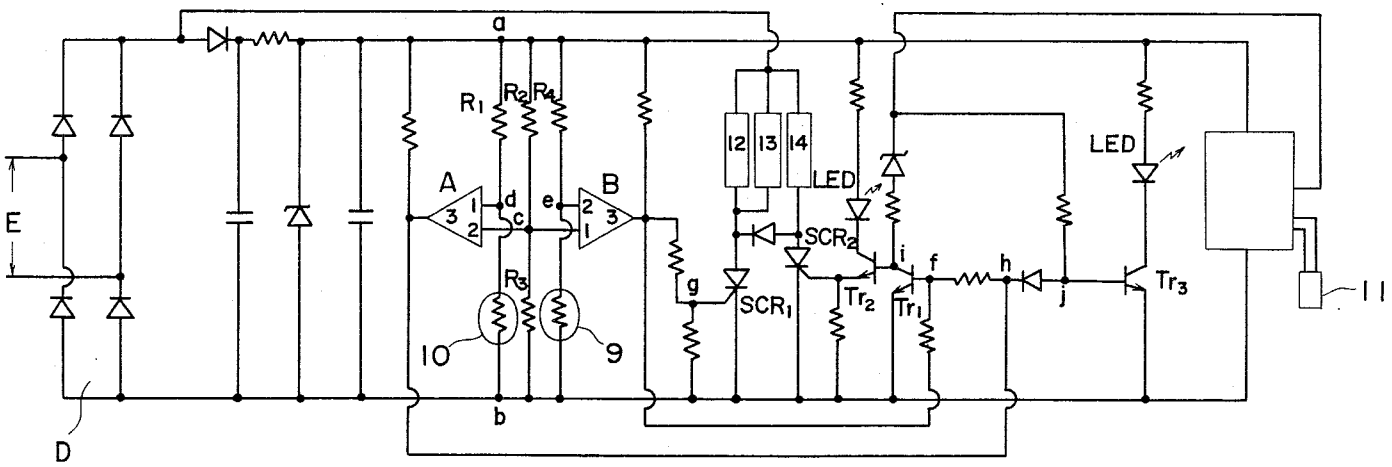
FIG. 4 is an electrical circuit diagram showing one preferred embodiment of the heater control circuit according to the present invention.

The detecting means 9, 10 and 11 and heaters 12, 13 and 14 are, for example, connected to a heater control circuit shown in FIG. 4.

Hereinbelow, the arrangement of the present invention will be described on the basis of the preferred embodiment thereof.

For the first and second temperature detecting means 9 and 10, thermistors are employed, with the first reference temperature (T1) and second reference temperature (T2) thereof being set at 20° C. and 35° C. respectively.

On the other hand, the known humidity detector sensor is employed as the humidity detecting means 11, with the reference humidity (H1) thereof being set at 70%.

As shown in FIG. 4, the heater control circuit is so arranged that the power source voltage E=100 V is rectified by the rectifying circuit D, with a voltage e1=12 V being impressed across terminals a and b. Meanwhile, the voltage is divided by resistors R2 and R3 having resistance value equal to each other, and a voltage E2=6 V is applied at a terminal c. The input terminal A1 of the comparator A is connected to an intermediate point d between the second temperature detecting means 10 in which the second reference temperature (T2) is set at 35° C. and the resistor R1, while the other input terminal A2 of the comparator A is connected to the terminal c to which the voltage E2=6 V is impressed.

Accordingly, when the resistance value of the second temperature detecting means, i.e. of the thermistor is varied due to the temperature variation within the copying apparatus and the potential of the input terminal A1 becomes lower than the potential of the other input terminal A2, High signal (referred to as H signal hereinbelow) is produced from the output terminal A3 of the comparator A, and on the contrary, when the potential of the input terminal A1 of the comparator A becomes higher than the potential of the other input terminal A2, Low signal (referred to as L signal hereinbelow) is emitted from the output terminal A3 of the comparator A.

Regarding the comparator B, the input terminal B1 thereof is connected to said terminal c, while the other input terminal B2 is connected to an intermediate point e between the first temperature detecting means 9 in which the first reference temperature (T1) is set at 20° C. and the resistor R4.

The function of the heater control circuit will be described hereinbelow.

(I) When the temperature (T) within the copying apparatus is lower than the first reference temperature (T1=20° C.);

Since the resistance values of the second temperature detecting means 10 and the first temperature detecting means 9 are high, L signal is emitted thereby from the output terminal A3 of the comparator A, while H signal is produced from the output terminal B3 of the comparator B.

Accordingly, the terminal f is rendered to be High by the H signal of the output terminal B3 of the comparator B, and the first transistor Tr1 is turned ON thereby, while the second transistor Tr2 is turned OFF. Therefore, the second thyristor SCR2 is turned OFF. In the above case, concerning the signal from the humidity detecting means 11, no voltage is impressed to the base of the second transistor Tr2 by the turning ON of the first transistor Tr1.

The first thyristor SCR1 is turned ON by the H signal of the output terminal B3 of the comparator B. whereby the heaters 12, 13 and 14 are heated.

(II) When the temperature (T) within the copying apparatus is higher than the first reference temperature (T1=20° C.) and lower than the second reference temperature (T2=35° C.); L signal is emitted from the output terminal A3 of the comparator A, while L signal is also produced from the output terminal B3 of the comparator B.

Therefore, the terminal g becomes Low by the output from the comparator B, with the first thyristor SCR1 turned OFF, and the heaters 12 and 13 are not energized. Meanwhile, the terminals h and f become Low by the output from the comparator A, and the first transistor Tr1 is turned OFF.

By the turning OFF of the first transistor Tr1, the second transistor Tr2 is turned ON.OFF by the signal from the humidity detecting means 11. More specifically, (II-a) When the humidity (H) within the copying apparatus is higher than the reference humidity (H1=70%); The humidity detecting means 11 produces H signal and the terminal i is rendered to be High thereby, with the second transistor Tr2 is turned ON. Consequently, the second thyristor SCR2 is turned ON, with the heater 14 being energized.

In the above case, if a light emitting diode LED is connected to the collector of the second transistor Tr2 is shown, it is possible to indicate that the heater 14 is energized.

Figure 1:
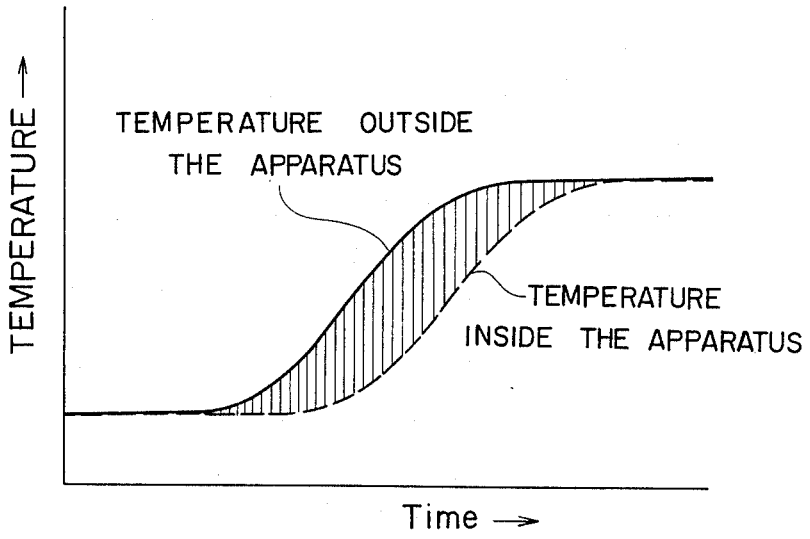
FIG. 1 is a graph explanatory of variations of temperatures inside and outside the copying apparatus.
Figure 2:
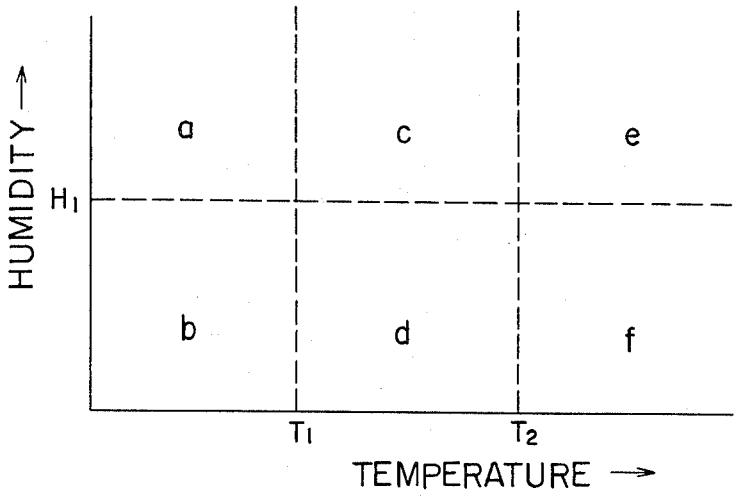
FIG. 2 is a diagram explanatory of ranges of temperatures and humidity.

Meanwhile, in the control circuit as described above, under the conditions where troubles due to the dew formation and humidity will not take place, i.e. when the humidity (H) in the copying apparatus is lower than the reference humidity (H1=70%) [the region (d) in FIG. 2], the humidity detecting means 11 emits L signal, thereby to render the terminal i Low and to turn OFF the second transistor Tr2 OFF. Accordingly, the second thyristor SCR2 is turned OFF, with the heater 14 not being energized.

Furthermore, when the temperature (T) in the copying apparatus is higher than the second reference temperature (T2=35° C.) [the regions(e), (f) in FIG. 2]; H signal is emitted from the output terminal A3 of the comparator A, while L signal is produced from the output terminal B3 of the comparator B.

Accordingly, the terminal g becomes Low by the output of the comparator B, with the first thyristor SCR1 turned OFF, and thus, the heaters 12 and 13 are not energized. Meanwhile, the terminals h and f are rendered to be High by the output from the comparator A, and the first transistor Tr1 is turned ON. The second transistor Tr2 is turned OFF by the turning ON of the first transistor Tr1, with the heater 14 not being energized.

It is to be noted here that, as shown in FIG. 4, according to the embodiment of the present invention, there are further provided a third transistor Tr3 and a light emitting diode indicating means LED for indicating the conduction of the transistor Tr3. By the above arrangement, when the humidity (H) in the copying apparatus is higher than the reference humidity (H1=70%); The humidity detecting means 11 emits H signal, with the terminal j becoming High, and thus, the third transistor Tr3 is turned ON, and the light emitting diode LED is also turned ON. This light emitting diode LED is intended to inform the operator of the abnormally high humidity in the copying apparatus, and the instruction for dehumidification is given to the operator by the lighting of this light emitting diode LED. Meanwhile, when the humidity (H) in the copying apparatus is lower than the reference humidity (H1=70%); The humidity detecting means 11 emits L signal, with the terminal j becoming Low, and consequently, the third transistor Tr3 and also the light emitting diode LED are turned OFF.

As is clear from the foregoing description, as shown in FIG. 2, the dew formation preventing heaters according to the present invention is so arranged that:

(I) When the temperature (T) within the copying apparatus is lower than the reference temperature (T1) of the first temperature detecting means [the regions(a), (b)], the first and second groups of heaters are heated to raise the temperature(T) within the copying apparatus, (II) When the temperature (T) is higher than the reference temperature (T1) of the first temperature detecting means and lower than the reference temperature (T2) of the second temperature detecting means, (II-a) With the humidity (H) within the copying apparatus being higher than the reference humidity (H1) [region (c)], only the second group of heaters is energized.

Furthermore, regarding the heaters to be installed at places other than those as described above, they have only to be connected in parallel to said first and second groups of heaters respectively for achieving the purpose, and thus not only the dew formation in the copying apparatus is prevented, but various troubles due to high humidity are advantageously prevented.

Moreover, by arranging the power source of the heater control circuit described in the foregoing embodiment to be in the connecting state irrelevant to the power switch of the copying machine, i.e. by arranging to maintain the functioning state by insertion into the power source plug socket, it is also possible to maintain the copying apparatus under favorable conditions at all times.

Furthermore, it is to be noted here that the copying apparatus of the foregoing embodiment to which the method of controlling heaters according to the present invention is applied, may be replaced by the transfer type copying apparatus for effecting said method.

Figure 5:
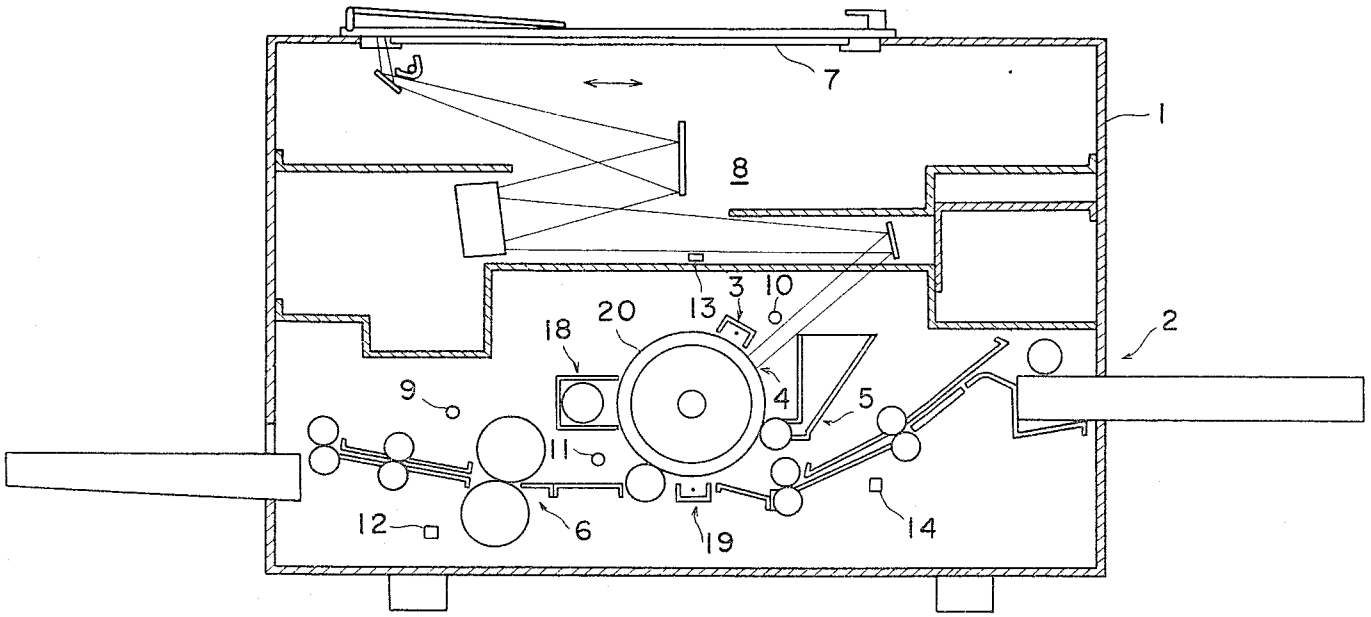
FIG. 5 is a schematic side sectional view of a transfer type electrostatic copying apparatus to which the method of the present invention may be applied.

For example, as shown in FIG. 5, a transfer device 19 and pressure roller fixing device 6 are installed in the apparatus housing along the path of the copy paper fed from the copy paper feeding section 2. Above the transfer device 19, there is disposed a photosensitive drum 20 which is covered with a photosensitive material such as selenium and the like, and around the drum 20, a corona charger 3, an exposure section 4, a developing device 5 and a cleaning section 18 are sequentially arranged. For projecting the image of the original document onto the exposure section 4, there are provided the optical system 8 and the original mouting table 7. In the conventional copying apparatus as described above, heaters 12, 13 and 14 are respectively provided in the fixing device 6, in the optical system 8 and adjacent the copy paper feeding section 2, while the first temperature detecting means 9, second temperature detecting means 10 and humidity detecting meas 11 are further provided, by which arrangement, owing to the functioning of the heater control circuit mentioned earlier, not only the troubles due to the dew formation and high humidity are prevented, but the surface of the photosensitive drum 20 is not subjected to low temperatures, and moreover, reduction of charge by the high humidity can be advantageously prevented. As described above, according to the present invention, by detecting the temperature and humidity within the copying apparatus, the dew formation in the copying apparatus is prevented, while simultaneously, various troubles inherent in the copying apparatuses can be eliminated.

What is claimed is:

1. A method of controlling heaters for a copying apparatus which indicates a first temperature detecting means for detecting the temperature within the copying apparatus, with a first reference temperature (T1) being set, a second temperature detecting means for detecting the temperature within the copying apparartus, with a second reference temperature (T2) higher than said first reference temperature (T1) being set, a humidity detecting means for detecting the humidity within the copying apparatus, with a reference humidity (H1) being set, and a first group of heaters and a second group of heaters to be controlled by said temperature detecting means and said humidity detecting means, said method comprising the steps of;

(I) heating said first and second groups of heaters when the temperature within the copying apparatus is lower than the reference temperature (T1) of said first temperature detecting means, and (II) heating said second group of heaters when the temperature (T) within the copying apparatus is higher than the reference temperature (T1) of said first temperature detecting means and lower than the reference temperature (T2) of said second temperature detecting means, (II-a) with the humidity (H) within the copying apparatus being higher than the reference humidity (H1) of said humidity detecting means.

* * * * *

UNITED STATES PATENT AND TRADEMARK OFFICE

CERTIFICATE OF CORRECTION

PATENT NO. : 4,259,565

DATED : March 31, 1981

INVENTOR(S) : Tetsuo OGINO et al

It is certified that error appears in the above-identified patent and that said Letters Patent are hereby corrected as shown below:

For "humity" in column 2, line 18, read "humidity".

For "E2" in column 4, line 53, read "e2".

For "E2" in column 4, line 58, read "e2".

For "meas" in column 7, line 28, read "means".

Signed and Sealed this

*Third* Day of *November 1981*

[SEAL]

*Attest:*

GERALD J. MOSSINGHOFF

*Attesting Officer*

*Commissioner of Patents and Trademarks*